US008407922B1

(12) United States Patent
Taylor

(10) Patent No.: US 8,407,922 B1
(45) Date of Patent: Apr. 2, 2013

(54) AMMUNITION MAGAZINE

(76) Inventor: Cary Taylor, Anchorage, AK (US)

( * ) Notice: Subject to any disclaimer, the term of this patent is extended or adjusted under 35 U.S.C. 154(b) by 154 days.

(21) Appl. No.: 13/153,252

(22) Filed: Jun. 3, 2011

(51) Int. Cl.
*F41A 9/61* (2006.01)

(52) U.S. Cl. ..... 42/49.01

(58) Field of Classification Search ..... 42/49.01–49.1, 42/17–18, 21–22, 24, 29, 33, 35, 37, 39, 42/6

See application file for complete search history.

(56) References Cited

U.S. PATENT DOCUMENTS 2,122,423 A * 7/1938 Joyce ..... 89/33.02
7,059,077 B2 * 6/2006 Tal et al. ..... 42/88
8,141,285 B2 * 3/2012 Brown ..... 42/71.01
D666,270 S * 8/2012 Taylor ..... D22/108
2005/0081421 A1 * 4/2005 Guy et al. ..... 42/88
2012/0036756 A1 * 2/2012 Brown ..... 42/71.01
2012/0317859 A1 * 12/2012 Brown ..... 42/71.01

* cited by examiner

*Primary Examiner* — Michael David
(74) *Attorney, Agent, or Firm* — QuickPatents; Kevin Prince

(57) ABSTRACT

The present device is an ammunition clip for holding rounds for a firearm having a magazine receiver. The clip includes a first channel for holding the rounds with the rim of each round protruding out. A cover is fixable with an open side of the first channel and holds the rims of each round slidably therein. A second channel is fixed adjacent to the first channel and holds the rounds with the rim of each round protruding outwards. A flange of the cover is adapted to retain rounds in the second channel when the cover is positioned over the first channel. With the first channel empty of rounds, the cover may be removed and slid over the rounds in the second channel. The cover is then lifted away from the second channel and fixed over the open side of the first channel to fill the first channel with more rounds.

8 Claims, 4 Drawing Sheets

AMMUNITION MAGAZINE

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to firearms, and more particularly to a quickly-reloadable ammunition clip.

DISCUSSION OF RELATED ART

Ammunition clips, also known as ammunition magazines, for firearms are well known, and provide the benefit of quickly loading and reloading of a firearm. When all the rounds of the ammunition clip are fired, the firearm may be reloaded traditionally by two techniques. One technique is to replace the empty ammunition clip with another loaded ammunition clip. A second approach is to remove the empty ammunition clip, reload the clip and reinsert the same clip back into the firearm. The first approach provides the advantage of being faster than the second approach. However, carrying multiple separate ammunition clips results in additional weight and bulkiness.

One approach to avoid carrying multiple clips is to provide high-capacity or extended-capacity ammunition clips that hold more rounds of ammunition compared to a standard ammunition clip. They reduce the frequency of needing to reload, however, they create the problem of providing additional length that can be undesirable and inconvenient when using the firearm. Another approach to avoid carrying multiple clips is to carry loose rounds of ammunition and reloading the initial clip manually with rounds one-by-one. This approach avoids the problems of excess weight and excess length, however, it still leaves a major drawback of being the most time consuming approach, which in certain circumstances can be a major disadvantage.

Therefore, there is a need for an ammunition clip that can be quickly reloaded. Such a needed device would avoid the excess weight of a complete replacement clip. The needed device would further provide a compact design and avoid the additional length created by extended capacity clips. The present invention accomplishes these objectives.

SUMMARY OF THE INVENTION

The present device is an ammunition clip for holding rounds for a firearm having a magazine receiver. The rounds each include a projectile and a case having a rim. The ammunition clip includes an arched first channel having a proximal end, a distal end, and an open side. The first channel is adapted for receiving the rounds therein with the rim of each round protruding from the open side of the first channel. A magazine assembly is fixed with the proximal end of the first channel and is adapted for insertion into the magazine receiver of the firearm and for delivering the rounds from the first channel to the firearm.

An arched C-shaped cover is selectively fixable with the open side of the first channel to substantially cover same, and is adapted to hold the rims of each round slidably therein. The cover further includes an arched, laterally projecting flange.

A follower mechanism is slidably retained within the first channel and urged by a spring towards the proximal end of the first channel. The follower mechanism further includes a tension lock projecting laterally away therefrom and traversing a lateral slot in the first channel. The tension lock is selectively fixable at a tension stop of the lateral slot proximate the distal end of the first channel.

An arched second channel is fixed laterally adjacent to the first channel and having an open side. The second channel is adapted for receiving the rounds therein with the rim of each round protruding from the open side of the second channel. The arched flange of the cover is adapted to retain rounds in the second channel when the cover is positioned over the first channel.

With the first channel empty of rounds, the tension lock of the follower mechanism may be manually fixed at the distal end of the first channel at the tension stop. The cover may be removed and slid over the rims of each round in the second channel to capture such rounds therein. The cover is then lifted away from the second channel with the rounds from the second channel and fixed over the open side of the first channel to fill the first channel with the rounds from the second channel. The tension lock is manually moved out of the tension stop such that the follower mechanism then urges the rounds into the magazine receiver.

The present invention is an ammunition clip that can be quickly reloaded. The device avoids the excess weight of a complete replacement clip. Further, device provides a compact design and avoids the additional length created by extended capacity clips. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word cover 60*s* all of the following interpretations of the word: any of the items in the list, all of the items in the list and any combination of the items in the list.

Figure 1:
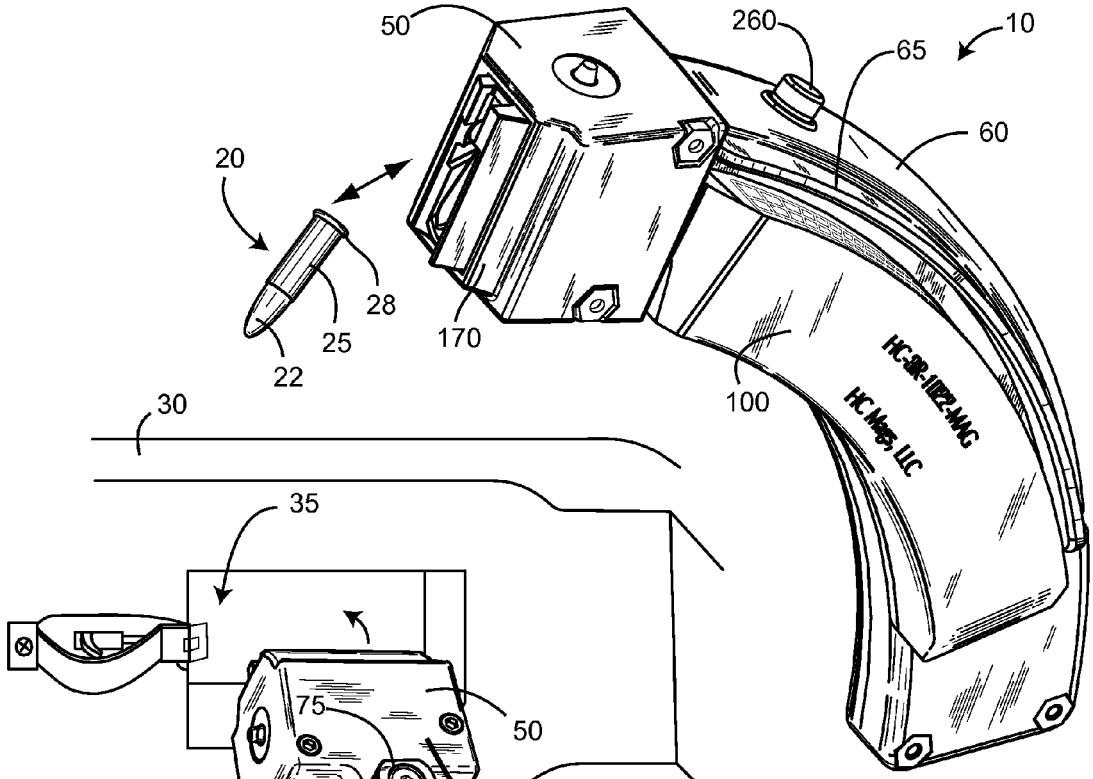
FIG. 1 is a left-side perspective view of the invention.
Figure 2:
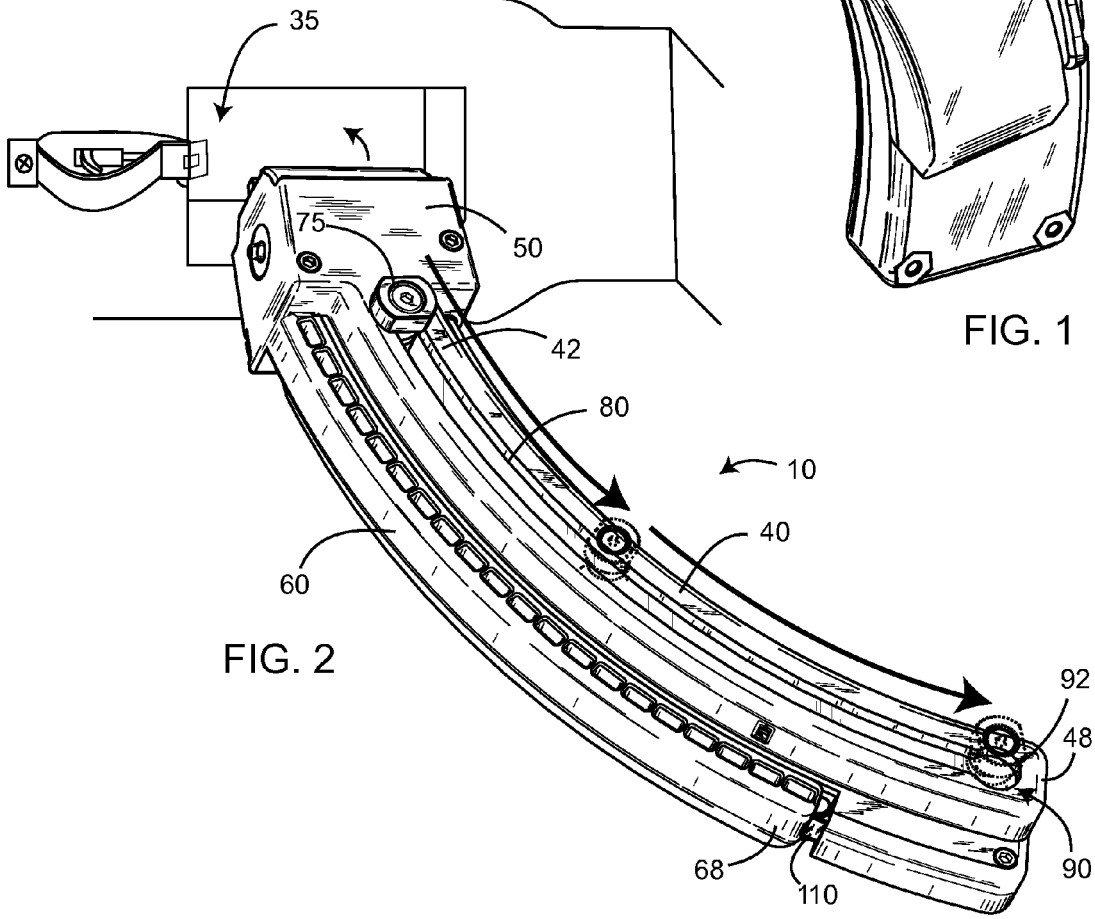
FIG. 2 is a right-side perspective view of the invention.
Figure 7:
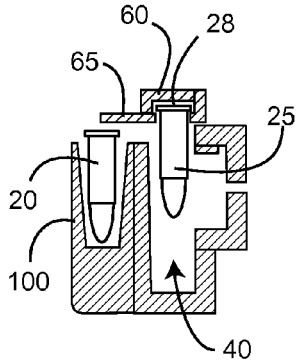
FIG. 7 is a perspective view taken generally alone lines 7-7 of FIG. 5.

With respect to the drawings, FIGS. 1 and 2 illustrate an ammunition clip 10 for holding rounds 20 for a firearm 30 having a magazine receiver 35. In FIGS. 1 and 7, the rounds 20 each include a projectile 22 and a case 25 having a rim 28. In FIGS. 2 and 7, the ammunition clip 10 includes an arched first channel 40 having a proximal end 42, a distal end 48, and an open side 45. The first channel 40 is adapted for receiving the rounds 20 therein with the rim 28 of each round 20 protruding from the open side 45 of the first channel 40. In a preferred embodiment, the ammunition clip 10 can be used with rim 28 med-caliber rounds, though the device may be made suitable for other caliber rounds having rims.

In FIGS. 1 and 2, a magazine assembly 50 is fixed with the proximal end 42 of the first channel 40 and is adapted for insertion into the magazine receiver 35 of the firearm 30 and for delivering the rounds 20 from the first channel 40 to the firearm 30.

Figure 6:
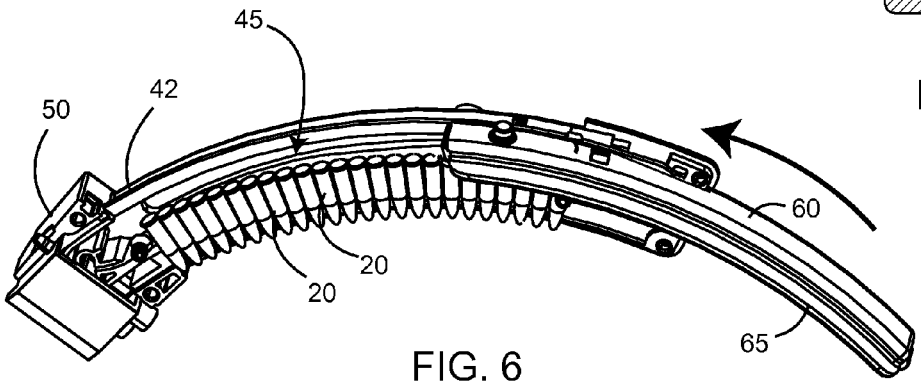
FIG. 6 is a partial perspective view of the invention, illustrating the cover.

In FIG. 6, an arched C-shaped cover 60 is selectively fixable with the open side 45 of the first channel 40 to substantially cover same, and is adapted to hold the rims 28 of each round 20 slidably therein. The cover 60 further includes an arched, laterally projecting flange 65 (FIG. 6).

Figure 3:
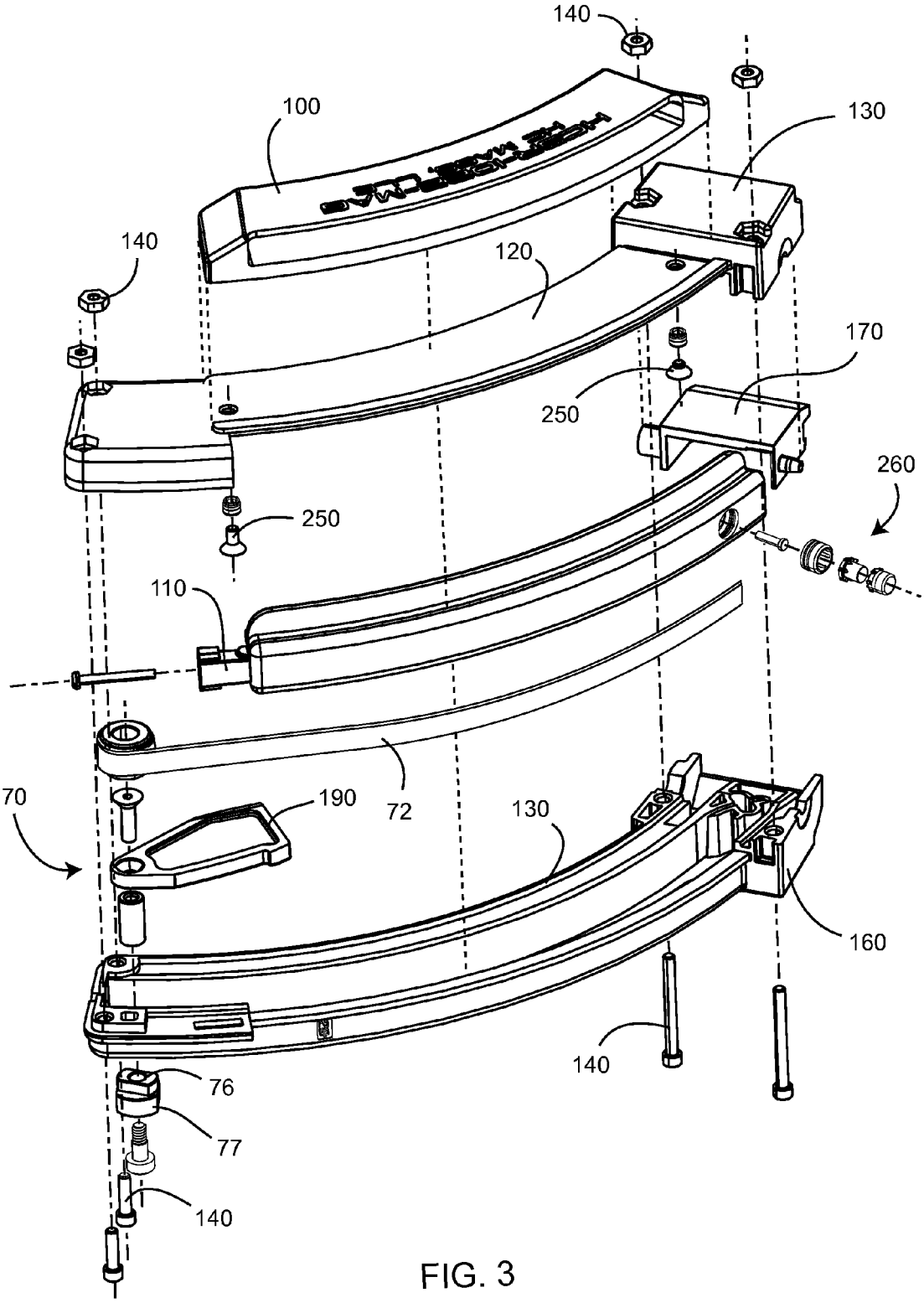
FIG. 3 is an exploded perspective view of the invention.

In FIG. 3, a follower mechanism 70 is slidably retained within the first channel 40 and urged by a spring 72 towards the proximal end 42 of the first channel 40. The follower mechanism 70 further includes a tension lock 75 (FIG. 3) projecting laterally away therefrom and traversing a lateral slot 80 in the first channel 40. The tension lock 75 is selectively fixable at a tension stop 90 (FIG. 2) of the lateral slot 80 proximate the distal end 48 of the first channel 40.

Figure 5:
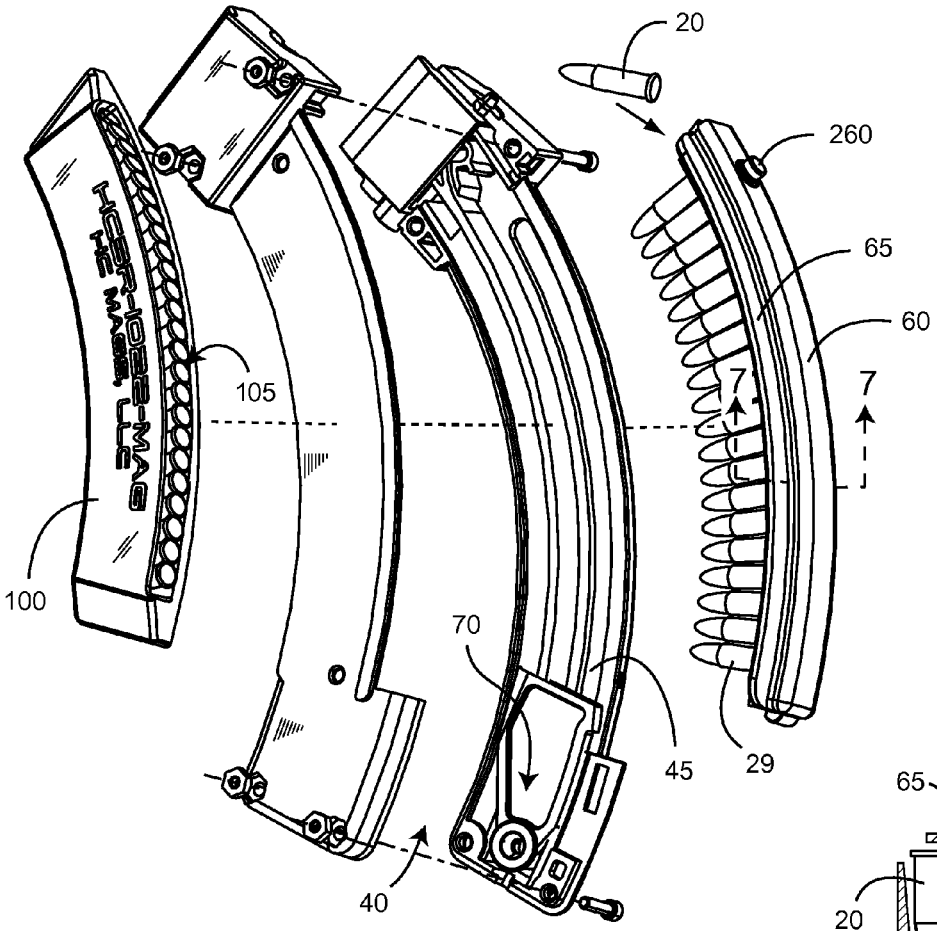
FIG. 5 is an exploded perspective view of the invention, illustrating a first channel and a second channel.

In FIGS. 3 and 5, an arched second channel 100 is fixed laterally adjacent to the first channel 40 and having an open side 105. The second channel 100 is adapted for receiving the rounds 20 therein with the rim 28 of each round 20 protruding from the open side 105 of the second channel 100. The arched flange of the cover 60 is adapted to retain the rounds 20 in the second channel 100 when the cover 60 is positioned over the first channel 40.

With the first channel 40 empty of rounds 20, the tension lock 75 of the follower mechanism 70 may be manually fixed at the distal end 48 of the first channel 40 at the tension stop 90. The cover 60 may be removed and slid over the rims 28 of each round 20 in the second channel 100 to capture such rounds 20 therein. The cover 60 is then lifted away from the second channel 100 with the rounds 20 from the second channel 100 and fixed over the open side 45 of the first channel 40 to fill the first channel 40 with the rounds 20 from the second channel 100. The tension lock 75 is manually moved out of the tension stop 90 such that the follower mechanism 70 then urges the rounds 20 into the magazine receiver 35.

In one embodiment, the first channel 40 includes a spring-biased latch 110 (FIG. 3) cooperative with a distal end 68 of the cover 60 to selectively retain the cover 60 onto the first channel 40. In another embodiment, illustrated in FIGS. 3 and 5, the first channel 40 is comprised of a first shell 120 and second shell 130 fixed together with a plurality of mechanical fasteners 140 (FIG. 3) with the follower mechanism 70 and spring 72 captured therebetween.

Figure 4:
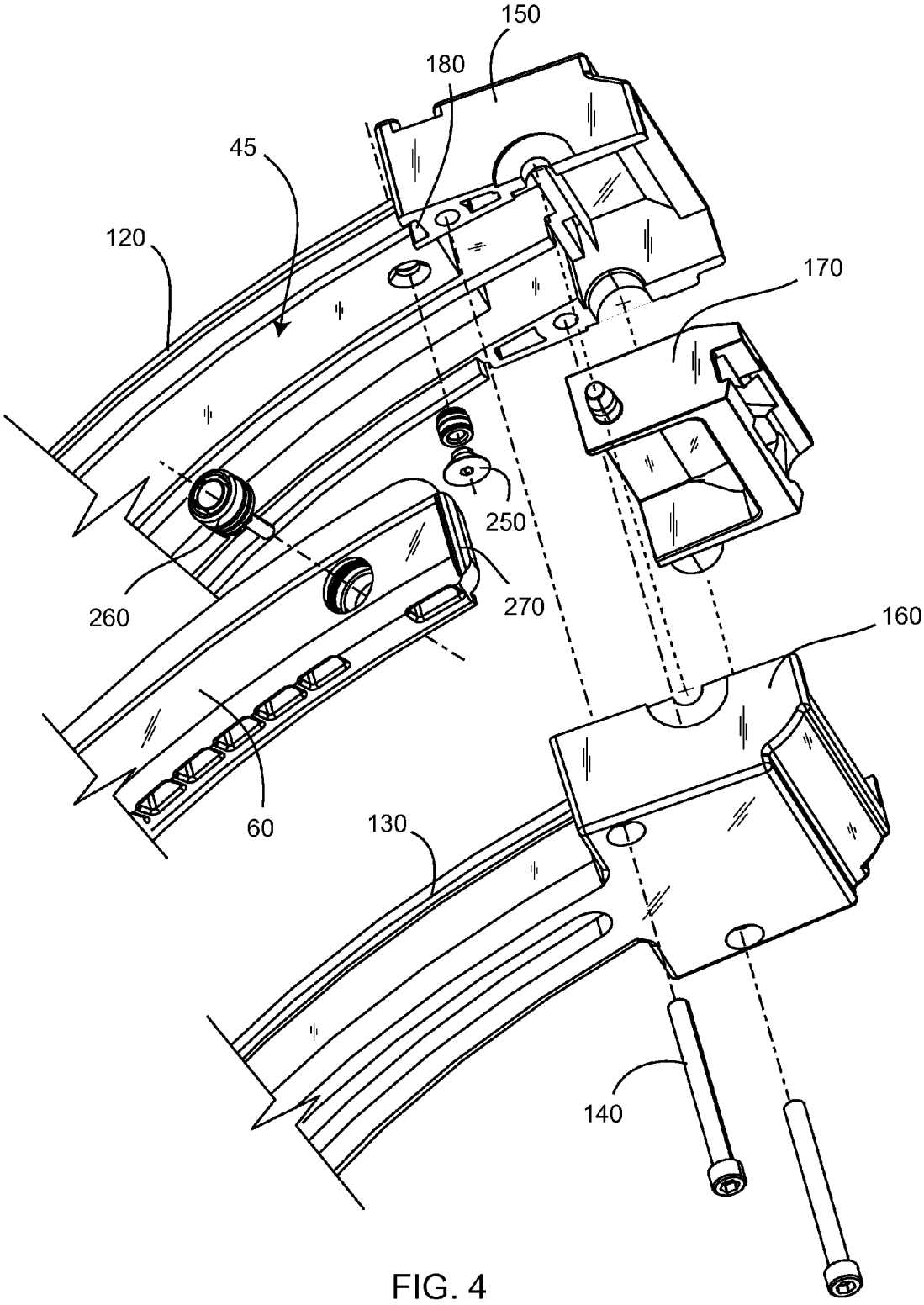
FIG. 4 is an exploded partial perspective view of the invention, illustrating a magazine assembly.

In another embodiment, as illustrated in FIG. 4, the magazine assembly 50 is comprised of a first portion 150 formed integrally with the first shell 120 of the first channel 40. A second portion 160 (FIG. 4) of the magazine assembly 50 is formed integrally with the second shell 130 of the first channel 40. In FIGS. 2 and 4, a pivoting dispenser 170 is adapted to receive the rounds 20 from the first channel 40 and deliver them to the magazine receiver 35 of the firearm 30. In one embodiment, the second channel 100 is fixed to the first shell 120 of the first channel 40 with a plurality of mechanical fasteners 140 (FIGS. 3 and 4).

In an alternate embodiment, illustrated in FIGS. 3 and 6, the cover 60 includes a manually-actuable latch release mechanism 260, whereby upon actuation a second latch 270 is retracted into the cover 60 to release the cover 60 from a notch of the first channel 40.

In another embodiment, illustrated in FIGS. 3 and 5, the follower mechanism 70 includes a plunger 190 shaped to travel through the first channel 40 and into the magazine assembly 50 to push a last round 29 (FIG. 5) through the pivoting dispenser 170.

In one embodiment, illustrated in FIGS. 2 and 3, the tension stop 90 is a circular aperture 92 of larger diameter than the width of the lateral slot 80. In this embodiment, the tension lock 75 includes an elongated tab 76 (FIG. 3) adapted for slidable capture within the lateral slot 80 of the first channel 40. A circular shoulder 77 (FIG. 3) is adapted for manual, selective insertion into the tension stop 90. When the tension lock 75 is pulled out of the tension stop 90, the elongated tab 76 slides within the lateral slot 80 and is urged towards the distal end 48 of the first channel 40 by the spring 72.

Such an ammunition clip 10 may be made primarily from plastic injection-molded material, for example, or from a steel or other metallic material, or the like. In a preferred embodiment much of the ammunition clip 10 may be made from 30% glass-filled nylon, providing strength to endure outside elements and strong forces associated with a firearm, yet remain relatively light compared to a heavier metal material.

While a particular form of the invention has been illustrated and described, it will be apparent that various modifications can be made without departing from the spirit and scope of the invention. For example, the cover 60 may include apertures in order to view the number of rounds 20 remaining in the ammunition clip 10. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An ammunition clip for holding rounds for a firearm having a magazine receiver, the rounds each including a projectile and a case having a rim, the ammunition clip comprising:

an arched first channel having a proximal end, a distal end, and an open side, the first channel adapted for receiving the rounds therein with the rim of each round protruding from the open side of the first channel;

a magazine assembly fixed with the proximal end of the first channel and adapted for insertion into the magazine receiver of the firearm and for delivering the rounds from the first channel to the firearm;

an arched C-shaped cover selectively fixable with the open side of the first channel to substantially cover same, and adapted to hold the rims of each round slidably therein, the cover further including an arched, laterally projecting flange;

a follower mechanism slidably retained within the first channel and urged by a spring towards the proximal end of the first channel, the follower mechanism further including a tension lock projecting laterally away therefrom and traversing a lateral slot in the first channel, the tension lock selectively fixable at a tension stop of the lateral slot proximate the distal end of the first channel;

an arched second channel fixed laterally adjacent to the first channel and having an open side, the second channel adapted for receiving the rounds therein with the rim of each round protruding from the open side of the second channel, the arched flange of the cover adapted to retain rounds in the second channel when the cover is positioned over the first channel;

whereby with the first channel empty of rounds, the tension lock of the follower mechanism may be manually fixed at the distal end of the first channel at the tension stop, and the cover may be removed and slid over the rims of each round in the second channel to capture such rounds therein, the cover then being lifted away from the second channel with the rounds from the second channel and fixed over the open side of the first channel to fill the first channel with the rounds from the second channel, the tension lock manually moved out of the tension stop such that the follower mechanism then urges the rounds into the magazine receiver.

2. The ammunition clip of claim 1 wherein the first channel includes a spring-biased latch cooperative with a distal end of the cover to selectively retain the cover onto the first channel.

3. The ammunition clip of claim 1 wherein the first channel is comprised of a first and second shell fixed together with a plurality of mechanical fasteners, the follower mechanism and spring captured therebetween.

4. The ammunition clip of claim 3 wherein the magazine assembly is comprised of a first portion formed integrally with the first shell of the first channel, a second portion formed integrally with the second shell of the first channel, and a pivoting dispenser adapted to receive the rounds from the first channel and deliver them to the magazine receiver of the firearm.

5. The ammunition clip of claim 4 wherein the follower mechanism includes a plunger shaped to travel through the first channel and into the magazine assembly to push a last round through the pivoting dispenser.

6. The ammunition clip of claim 3 wherein the second channel is fixed to the first shell of the first channel with a plurality of mechanical fasteners.

7. The ammunition clip of claim 1 wherein the cover includes a manually-actuable latch release mechanism, whereby upon actuation a second latch is retracted into the cover to release the cover from a notch of the first channel.

8. The ammunition clip of claim 1 wherein the tension stop is a circular aperture of larger diameter than the width of the lateral slot, and wherein the tension lock includes an elongated tab adapted for slidable capture within the lateral slot of the first channel, and a circular shoulder adapted for manual, selective insertion into the tension stop, whereby when the tension lock is pulled out of the tension stop the elongated tab slides within the lateral slot, urged towards the distal end of the first channel by the spring.

* * * * *